US008517067B2

(12) United States Patent
Barnhill

(10) Patent No.: US 8,517,067 B2
(45) Date of Patent: Aug. 27, 2013

(54) FOLDABLE CHAIN SAW WORKBENCH

(76) Inventor: Arie Barnhill, Siloam Springs, AR (US)

( * ) Notice: Subject to any disclaimer, the term of this patent is extended or adjusted under 35 U.S.C. 154(b) by 222 days.

(21) Appl. No.: 12/932,007

(22) Filed: Feb. 16, 2011

(65) Prior Publication Data

US 2012/0205009 A1 Aug. 16, 2012

(51) Int. Cl.
*B25H 1/00* (2006.01)

(52) U.S. Cl.
USPC ..... 144/286.5; 144/286.1; 269/17

(58) Field of Classification Search
USPC ..... 144/286.1, 286.5; 269/17, 289 R; 280/641, 645, 652, 47.17, 47.19; 83/574, 83/788–820; 108/115, 118–123, 128
See application file for complete search history.

(56) References Cited

U.S. PATENT DOCUMENTS

| | | | | |
|---|---|---|---|---|
| 2,851,067 | A | 9/1958 | Greenslate | |
| 3,053,290 | A | 9/1962 | Fitzgerald | |
| 4,127,046 | A | 11/1978 | Jackson | |
| 4,210,049 | A | 7/1980 | Gauthier | |
| 4,214,498 | A * | 7/1980 | Zukas et al. | 83/796 |
| 4,215,612 | A | 8/1980 | Peel | |
| 4,307,640 | A | 12/1981 | Michael | |
| 4,350,067 | A | 9/1982 | Picard | |
| 4,351,209 | A | 9/1982 | Alford | |
| 4,606,252 | A | 8/1986 | Lahti | |
| 4,757,735 | A * | 7/1988 | Olson | 83/797 |
| 4,779,503 | A | 10/1988 | Mitchell | |
| 7,159,496 | B2 | 1/2007 | Maes | |
| 7,159,499 | B1 | 1/2007 | Lanser | |
| 7,543,614 | B2 * | 6/2009 | Wise | 144/286.5 |
| 7,581,477 | B2 | 9/2009 | Allen | |
| 7,661,346 | B1 | 2/2010 | Rekhels | |
| 7,762,510 | B2 | 7/2010 | Eller | |
| 2010/0122618 | A1 | 5/2010 | Lugmayer | |
| 2010/0257743 | A1 | 10/2010 | George | |
| 2012/0111170 | A1 * | 5/2012 | Steinfort | 83/796 |

* cited by examiner

*Primary Examiner* — Dana Ross
*Assistant Examiner* — Matthew G Katcoff
(74) *Attorney, Agent, or Firm* — Stephen D. Carver

(57) ABSTRACT

A portable quick-erecting chain saw workbench has a foldable, wheeled carriage that releasably receives a controller upon which a chain saw is secured. The carriage comprises a plurality of panels that are folded between an operational configuration and a stowage orientation. A controller tube adjustably mated to the carriage has pedestal that secures the saw. A spring suspension controls the saw during cutting. A vertical carriage fence with a central blade clearance slot supports a pair of spacers mounting a pair of foldable legs. Cooperating stabilizers permanently hinged to the fence can be folded and pinned to the legs for bracing. Spaced-apart hinge leaf halves at the stabilizer bottoms mate with similar hinge leaf halves for pinning the stabilizers when the carriage is deployed. A foldable work table pivoted to a leg is braced by a strut extending from the table underside to a pinning point.

4 Claims, 12 Drawing Sheets

FOLDABLE CHAIN SAW WORKBENCH

BACKGROUND OF THE INVENTION

1. Field of the Invention

The present invention relates generally to chain saws, and to workbenches for safely using them. More particularly, the present invention relates to portable, folding workbenches adapted to be deployed to safely control chain saws for cutting and sawing diverse items in a safe and efficient manner.

2. Description of the Related Art

Conventional chain saws are powered by small gasoline or electric engines. Modern chain saws are in widespread use, particularly for cutting or trimming trees and large branches, or for cutting fireplace wood. The modern frequency and intensity of storms, including wind storms and tornadoes, and the resultant damages to trees and tree limbs, accentuates the value of a modern chain saw as a necessary household appliance. Chain saw use for cutting home firewood for heating has increased demonstrably as well.

Chain saws comprise a powered blade that revolves about a flat, elongated bar or "blade" that supports chain rotation. Numerous rigid, sharpened teeth supported by the revolving chain vigorously cut through workpieces such as branches, trees, logs and the like. Many conventional chain saws are lightweight and portable. Most chain saws include various types of guard structures designed to prevent the saw blade from inadvertently contacting and injuring the user. The handle by which the saw can be lifted and manipulated usually includes safety features such as automatic shut off switches. Various types of safety guards known in the art exist as well.

Despite the numerous safety advances engendered by modern saw designs, numerous dangers exist. In the first place, numerous users never read the saw's operating manual, or discern the numerous safety warnings printed in the manual. Modern chain saws typically require two hands to operate, but some users may try to hold workpieces in one hand while operating the saw with their other hand. Chain saw kickback is a well recognized danger. Kickback can unexpectedly occur when saw teeth impact with the workpiece during chain rotation, whereupon the saw may dangerously lurch backwardly towards the operator. Kickback often occurs when the blade of a chain saw strikes a metal object embedded in the workpiece. Unexpected saw movements may also occur when the operator completes a cut through a workpiece, and the saw suddenly frees itself and emerges from the workpiece as for example, when a log or branch is cut all the way through.

Chain saw weight is also a factor contributing to accidents. Although modern chain saws are designed to be lightweight, larger, heavier saws can become difficult to control, especially when operator fatigue develops. Weight makes it difficult to cut smaller workpieces that may not be mechanically anchored or tied down securely. This is especially true when the workpiece is not heavy enough to support itself, and must be supported during cutting by the foot or arm of the operator who may be standing in an unstable position. Operator fatigue can develop notwithstanding the supposed light weight of modern chain saws. Substantial physical exertion is required when cutting over large time periods. Fatigue develops as an operator continually bends over and straightens up, bearing the full weight of the saw.

Partly in effort to reduce accidents, and to simplify and streamline chain saw operation, various chain saw benches have evolved in the art. Usually such benches provide a stable horizontal surface for the workpiece, and means for bracing or securing the saw. Additional diverse tables including a variety of safety measures are also known in the art.

For example, U.S. Pat. No. 4,127,046 issued Nov. 28, 1978 discloses a portable bench for controlling a chain saw when sawing a workpiece. A saw blade guide plate projects through a slot defined in a mounting plate. The saw blade is protected by a guard pivotally secured to the mounting plate. A cradle frame that pivots about a horizontal axis releasably receives and clamps the mounting plate in a table sawing position when the chain saw is used. A pivotally supported turntable is positioned beneath and supports the pedestal. A workpiece-supporting table is positioned adjacent the cradle frame structure, pedestal and turntable, and has a substantially horizontal working surface located below the guide plate of the chain saw.

U.S. Pat. No. 4,210,049 issued Jul. 1, 1980 discloses a frame for supporting a chain saw. The foldable, tubular frame comprises a pair of elongated, spaced-apart legs supporting an elongated, rotatable shaft. A conventional chain saw is removably affixed to the shaft outside one end of the frame in a cantilever position. An elongated trough extends horizontally of the frame. The lower portion of the frame is anchored to avoid tipping. A control lever extends from the shaft alongside the saw, within the frame, so that the operator is protected from the saw chain.

U.S. Pat. No. 4,214,498 issued Jul. 29, 1980 discloses a control apparatus for supporting and operating a chain saw. A table for supports wood to be cut and an elongated actuating arm mounted on the table.

U.S. Pat. No. 4,215,612 issued Aug. 5, 1980 discloses another chain saw support. A supporting frame includes a bed for supporting a length of wood within the path of the saw blade. The saw blade is biased toward one side of the length of wood and a foot treadle is connected to the saw for overcoming the bias and moving the saw blade along the straight-line path to the other side of the length of wood.

U.S. Pat. No. 4,307,640 issued Dec. 29, 1981 discloses a supporting worktable for chain saws. The chain saw is swung about a fixed pivot to bring the chain of the saw into cutting engagement with a workpiece that is supported in an elevated position and restrained from movements. The table comprises a trough shaped top, and a pivoted and adjustable mounting plate that secures the saw.

U.S. Pat. No. 4,350,067 issued Sep. 21, 1982 discloses a chain saw mount for supporting and counterbalancing a portable power chain saw so that it may be manually swung by its handle between raised and lowered positions for cutting a workpiece supported by the apparatus.

U.S. Pat. No. 4,351,209 issued Sep. 28, 1982 discloses a chain saw bench having a first support member with an interdigital slot, a second support member having a cooperating slot for mating with the first support member to form a cross, and a top member hinged on a side parallel to its slot. The top member includes means for restraining the handle and body of the chain saw and positioning the saw to permit access to the top of said bar and chain. Remote control means are attached to the trigger of the saw. A pedal-type activator positioned remote from the saw activates the saw by pressure either from the operator's knee or from the operator's foot.

U.S. Pat. No. 4,606,252 issued Aug. 19, 1986 discloses apparatus used for supporting and controlling chain saws. The saw may be swung by its handle between raised and lowered positions, for cutting workpieces supported beneath.

U.S. Pat. No. 4,779,503 issued Oct. 25, 1988 discloses a portable stand for cutting timber. A vertical support mounted upon a base defines a functional area for resting work pieces to be cut. A second functional area for an operator to be located is defined on the opposite side of the vertical support. A beam mounted horizontally upon and parallel to the vertical support secures the chain saw mount is pivotally disposed upon the beam for removably receiving a chain saw, the chain saw mount adapted for movement along the axis of the beam. A clamp arm clamps onto timber disposed upon the first functional area for resting timber.

U.S. Pat. No. 7,159,496 issued Jan. 9, 2007 discloses a portable vise and saw including a vise with three attachment points. One attachment point is used to attach the vise to an existing support such as an existing horizontal rail, and another attachment point allows a saw to be mounted to the vise. A workpiece is mounted in the third attachment point. The saw is aligned with the workpiece so that the workpiece may be selectively cut at a desired length and angle. A measuring apparatus is also incorporated within the vise to allow an operator to set the saw to cut successive workpieces at the same lengths without having to remeasure each workpiece.

U.S. Pat. No. 7,159,499 issued Jan. 9, 2007 provides a support for portable band saws. A pivoting mount is maintained at a work surface. A bracket adjacent the mount receives a front portion of a blade housing structure of the portable saw. An extension bar supports a rear portion of the blade housing structure.

U.S. Pat. No. 7,581,477 issued Sep. 1, 2009 discloses a saw table and clamping mechanism for securing a work piece on the saw table. The clamping mechanism includes a clamping bar having a first end and a second end with a longitudinal axis defined therebetween. A first pivoting arm operatively connected to the clamping bar enables rotation about a pivot axis. A biasing device biases the clamping bar about the pivot axis to clamp the work piece between the clamping bar and a table base.

U.S. Pat. No. 7,661,346 issued Feb. 16, 2010 discloses a guide assembly for power tools with a rectilinear guide and a rotary guide slidably attached to the rectilinear guide with a post with axially opposed top and bottom ends. The rotary guide includes a knob provided with a rod with a first end directly attached to a bottom surface of the knob. The assembly further includes a mechanism for slidably attaching the rotary guide to the rectilinear guide and a mechanism for removably securing the rectilinear guide to a support surface.

U.S. Pat. No. 7,762,510 issued Jul. 27, 2010 discloses handsaw mounting assemblies and methods. A frame comprises a top portion configured to removably couple a saw motor assembly, and a bottom portion configured to fixedly couple a structure. A method of affixing a handsaw to a structure that includes removably coupling a motor assembly portion of the handsaw to a structure using an assembly.

U.S. Pat. No. Application No 2010/0122618 published May 20, 2010 discloses a folding base that converts a portable band saw into a fixed tool that may be used on a workbench. The mounting base has upper and lower cradles, the upper cradle folding down next to the lower cradle for storage. In use, the handle of the portable tool in placed in the upper and lower cradles, and held in position by a toggle clamp. The toggle clamp engages the hand tool trigger to maintain the tool in an operating condition.

U.S. Pat. No. Application No. 2010/0257743 published Oct. 14, 2010 discloses systems and methods for a chain saw safety device. A method comprises the steps of activating a chain saw, receiving a first acceleration value associated with acceleration of the chain saw, comparing the first acceleration value to a predetermined acceleration threshold, and deactivating the chain saw based on the comparison.

Despite all of the known advances in chain saw supports, known chain saw benches do not adequately combine ease of use with sufficient chain saw control to promote operator safety. Moreover, no known chain saw table providing the foregoing attributes is enabled to fold into a substantially flat stowage position.

BRIEF SUMMARY OF THE INVENTION

The preferred chain saw workbench comprises a foldable, wheeled carriage that releasably supports a removable controller. A conventional chain saw is secured to the controller for cutting workpieces disposed on a table associated with the deployed carriage. The carriage comprises a plurality of foldably-interconnected planar panels that are foldably deployed between an operational configuration and a reduced volume stowage orientation.

The controller comprises an elongated support tube that is slidably mated to a stub fixed to the carriage. A chain saw is secured to a pedestal hinged to the support tube for pivotal movements. The controller has a spring suspension system for dynamically stabilizing the chain saw and an elongated trigger deflector for saw operation.

The foldable carriage comprises a planar, vertical fence at its center with a central slot for blade clearance. A pair of rectangular spacers secured to the fence secure a pair of foldable legs that pivot to a divergent operational orientation. A pair of cooperating stabilizers permanently pivoted to the fence bottom can be folded and pinned to the legs to brace the carriage. Both stabilizers are permanently pivotally coupled at their bottoms to the fence with hinges. Spaced-apart hinge leaf halves at the stabilizer bottoms mate with similar hinge leaf halves for pinning the stabilizers when the carriage is deployed.

A foldable work table preferably comprising a pair of layered boards is pivoted to one leg with hinges. The table is braced by a strut pivoted at its top to the bottom underside of the table. The bottom of the strut has a pair of hinge leaf halves that mate with similar leaf halves on the leg that are pinned together when the strut is disposed vertically and the carriage is deployed.

Thus a basic object of my invention is to provide a portable work bench for safely operating chain saws.

Another primary object is to provide a portable chain saw work bench that is portable and easy to transport and stow.

A major object of the present invention to provide chain saw support apparatus which increases safety and prevents accidents.

It is another object of the present invention to provide a portable chain saw support of reliable construction that can be readily deployed for use, or folded for transportation or stowage.

Yet another object is to provide a chain saw work bench that secures the saw properly, and does not interfere with operation of the typical saw's safety apparatus.

Another object is to provide a saw bench of the character described that minimizes operator fatigue and error.

Yet another object of my invention is to provide a saw bench of the character described that eases the chores of cutting fireplace or wood stove logs into uniform lengths suitable for burning.

It is a general object of this invention to provide an improved method and apparatus for cutting logs that will greatly reduce, if not entirely eliminate the danger of physical injury to which chain saw operators generally, and new owners of chain saws in particular, have heretofore been subject.

Another general object of my invention is to improve the accuracy, effectiveness and efficiency of chain saw cutting.

Yet another object is to provide a dexterous work bench that facilitates reasonable and necessary chain saw movements during cutting operations, while safely supporting the saw.

It is also an object of the invention to provide a chain saw bench for wood cutting that securely holds and braces the saw, so that one hand is free to manipulate the wood.

A related object of this invention is to simplify wood cutting to ease the burdens of an operator when cutting large amounts of wood.

A further object of the present invention is the provision of an apparatus permitting a chain saw to be used in cutting short lengths of wood without danger to the user.

It is another object of the instant invention to provide a saw work bench that uses a chain saw already owned by the user.

A still further object of the invention is the provision of wood cutting apparatus which is simple to use, which is inexpensive to manufacture, and which is capable of a long life of useful service with a minimum of maintenance.

Another object of the invention is the provision of chain saw apparatus which can be folded for storage in a small space and which is light in weight.

A further object of my invention is to provide a chain saw bench of the character described that can be quickly and easily deployed or folded for stowage or transportation without the use of hand tools.

Another object of the invention is to provide a combination portable and stationary, bench-mounted chain saw apparatus which is characterized in having a long and trouble-free operating life.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
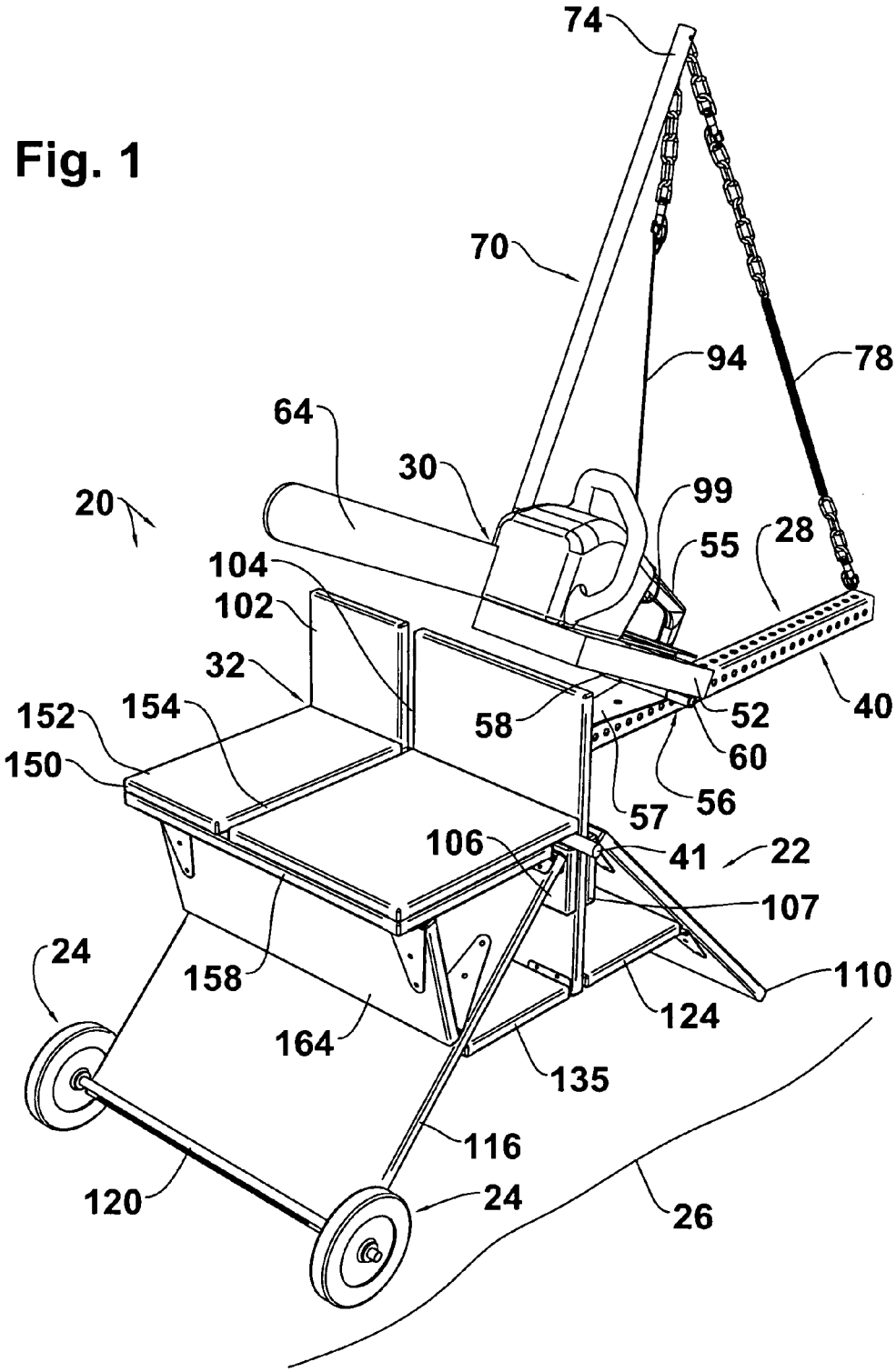
FIG. 1 is a frontal isometric view of my new chain saw workbench, showing it in a deployed orientation.
Figure 2:
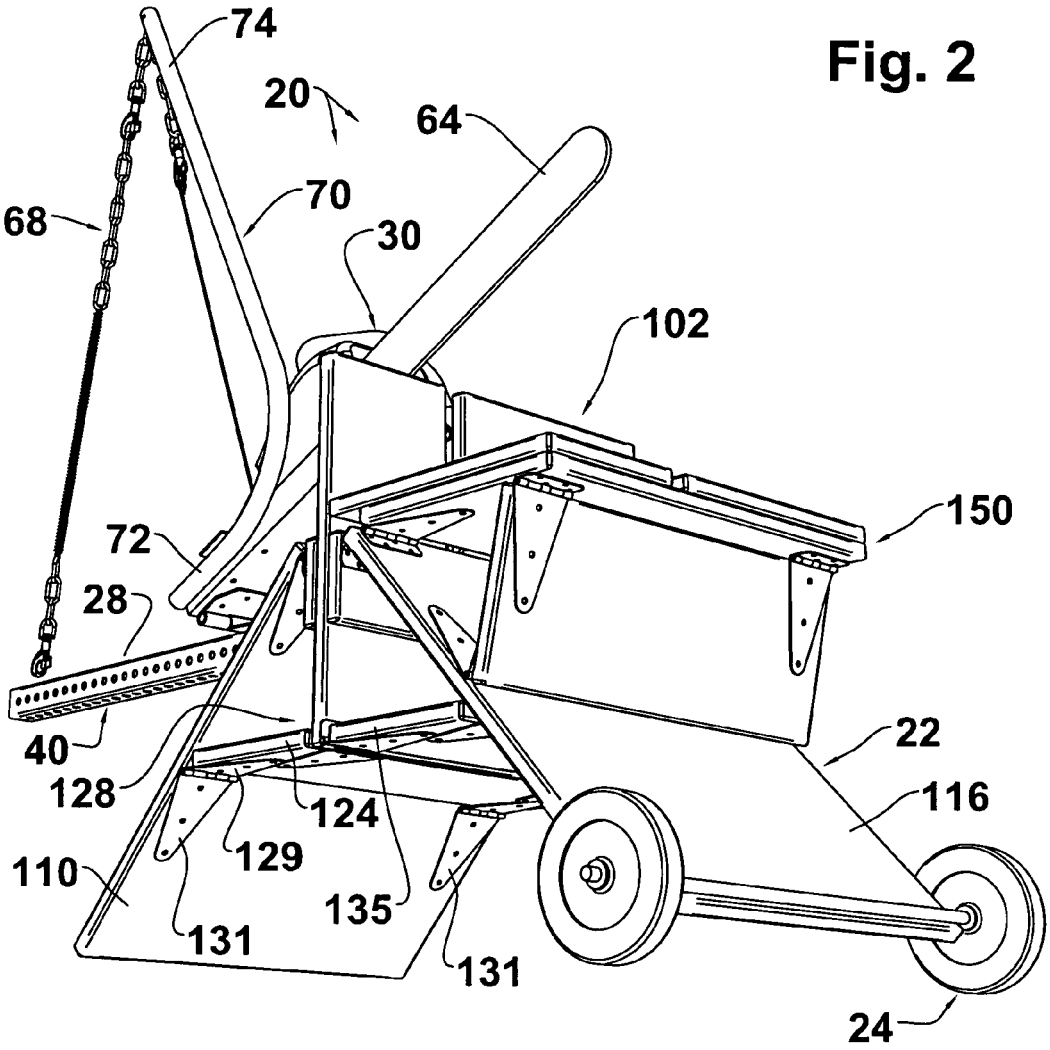
FIG. 2 is an isometric view of the workbench, showing a side opposite that illustrated in FIG. 1.

With initial reference directed to FIGS. 1-4 of the appended drawings, a foldable chain saw workbench constructed generally in accordance with the best mode of the invention has been generally designated by the reference numeral 20. A foldable carriage, generally designated by the reference numeral 22, can be unfolded and deployed as in FIG. 1. Preferably the carriage 22 comprises at least a pair of wheels 24 that aid in moving the workbench 20 over a supporting surface 26 to a convenient work location. The carriage supports a removable controller 28 that mounts and controls a conventional chain saw 30, which can safely cut workpieces disposed upon the work shelf 32 presented by the carriage 22 when unfolded and deployed for use. Carriage 22 comprises a plurality of foldably-interconnected planar panels that form the superstructure when deployed, and which present the horizontally oriented cutting shelf 32 upon which workpieces to be cut can be safely placed.

Controller 28 suspends the chain saw 30 for limited movements needed for cutting. Preferably the controller 28 is removably coupled to the carriage 22 when the workbench 20 is properly deployed. As best viewed in FIGS. 1-3 and 5, controller 28 comprises an elongated, rigid tube 40 of generally square cross section that has numerous spaced apart perforations 42 in its sides, with additional perforations 44 defined in its top and bottom. Controller tube 40 is telescopingly, coaxially mated to a similarly configured and perforated connection stub 48 (i.e., FIG. 5) of slightly larger dimensions presenting a socket for connection. Stub 48 is welded to a small, narrow, flat metallic plate 49 (FIG. 8, 9-12) that is fastened internally to fence 102. When properly connected to stub 48 and deployed, the controller tube 40 is oriented substantially horizontally over ground 26 (FIG. 1). Pin 50 can lock the tube 40 into place when mated to stub 48. Aligned perforations or orifices are chosen such that a proper length is established. The overall length of the stub and the controller tube 40 are variable. In other words, to accommodate chain saws of different sizes and dimensions, and to handle different job applications involving varying workpieces, the tube 40 may be variably slidably coupled to stub 48 to present a proper work length. Once the proper spacing is chosen, pin 50 (FIG. 5) is inserted to lock tube 40 into stub 48.

Figure 3:
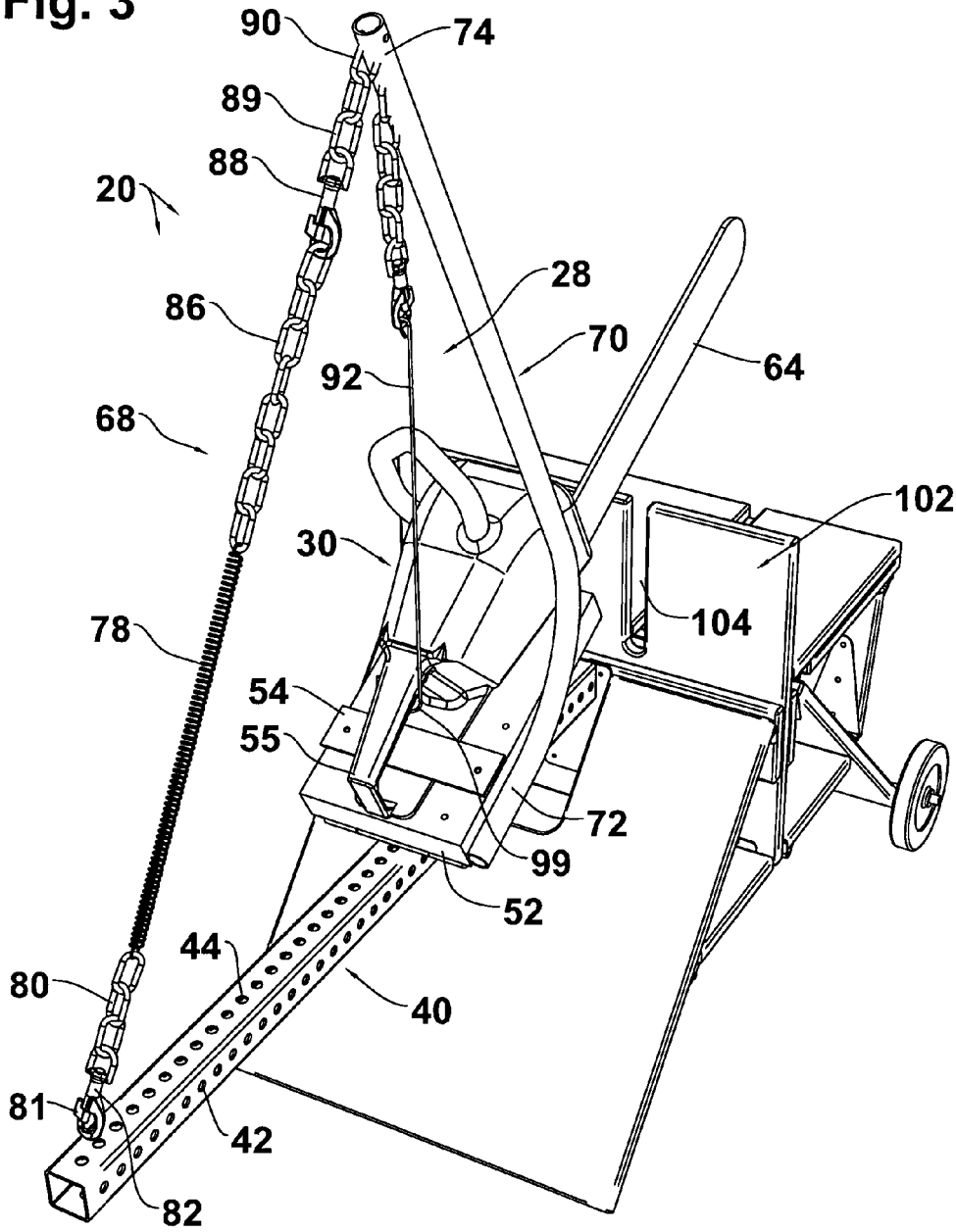
FIG. 3 is a top isometric view of the workbench.
Figure 5:
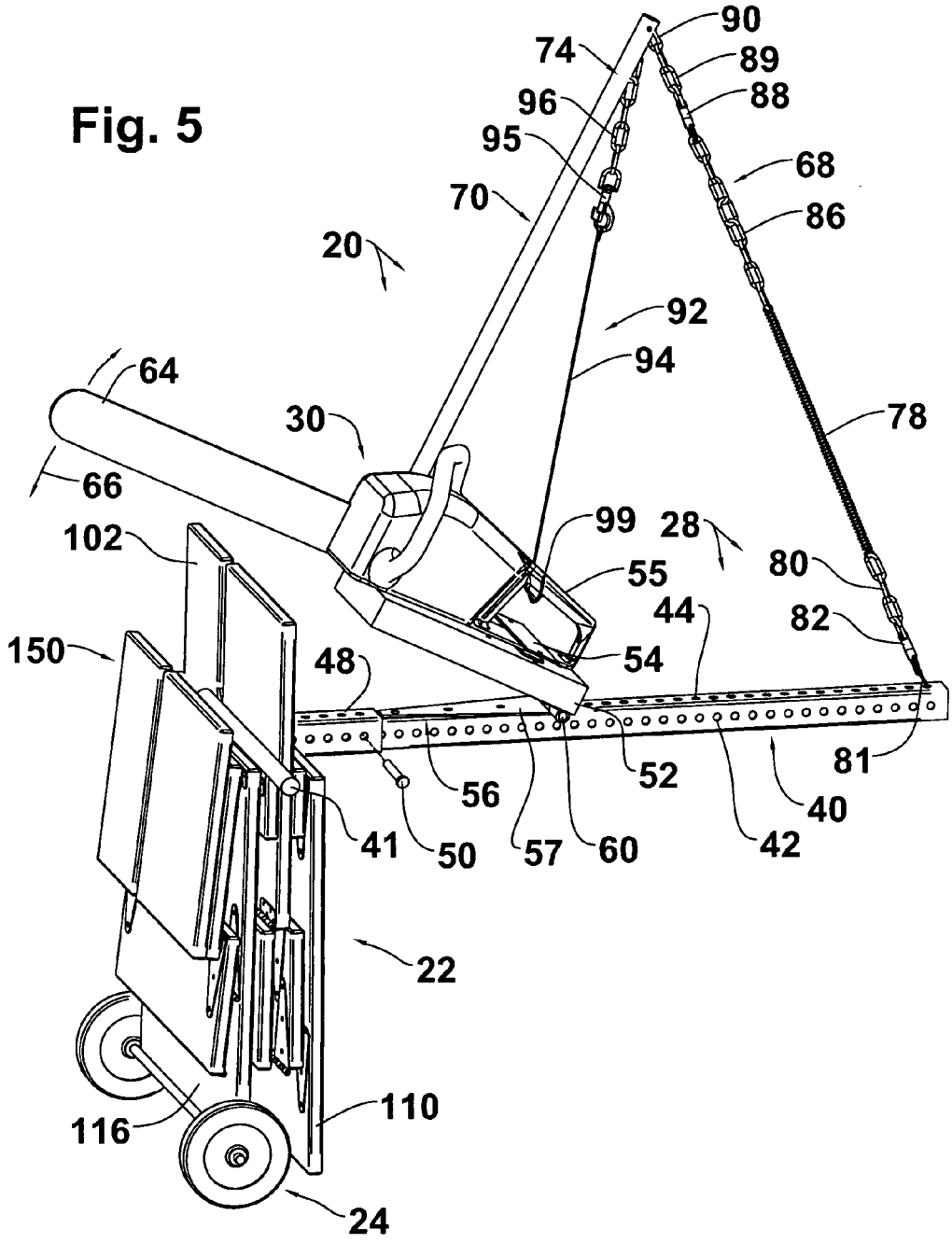
FIG. 5 is an isometric view of the workbench with the carriage folded for stowage.

The chain saw 30 is supported by controller 28 upon tube 40. The chain saw is secured to a supporting pedestal 52 by a transverse brace 54 that overlies the chain saw grip 55 (FIGS. 3, 5). Brace 54 is securely fastened to pedestal 52 by suitable fasteners so that the chain saw underside flushly and securely abuts the upper surface of the pedestal 52. Brace 54 prevents inadvertent chain saw movement, including torsional displacements. Pivoting movement is enabled by a lower hinge 56 that mounts the pedestal 52 to the tube 40. The lower leaf 57 (FIGS. 1, 5) of the hinge 56 is secured to tube 40 by suitable fasteners that penetrate upper tube perforations 44. The upper hinge leaf 58 (FIG. 1) is centered beneath pedestal 52 and secured to its underside. A pivot axis of rotation is established at hinge joint 60. Thus the pedestal 52 and the chain saw 30 borne by it can pivot upwardly or downwardly relative to tube 40, with the blade 64 of the chain saw 30 being displaceable as generally indicated by arrows 66 (FIG. 5).

Chain saw motion is dynamically limited and controlled by a spring suspension system 68, which operates in conjunction with a rigid, generally J-shaped handle 70. As best seen in FIG. 3, the handle 70 comprises a lower base portion 72 that is affixed to the side of pedestal 52. An integral, upwardly extending handle portion extends generally forwardly of the pedestal, and rises vertically above the chain saw. The suspension 68 extends generally diagonally between the top of the elevated handle portion 74 and the rear of tube 40 to naturally bias the chain saw out of engagement with a workpiece, substantially as shown in FIG. 5. The suspension 68 comprises an elastic spring 78 whose lower end is connected via a series of chain links 80 and a clasp 82 to an anchor 81 at the rear of tube 40. The upper portion of the suspension spring 78 is connected to the handle 70 via a first series of chain links 86, an intermediate clasp 88, and a second series of chain links 89 emanating from U-shaped anchor 90 atop handle portion 74. In use, when handle 70 is firmly grasped and pushed forward, the chain saw will pivot into engagement with a workpiece against predetermined tension fro the suspension spring 78. Spring tension can be varied by attaching clasps 82 and/or 88 to various ones of the chain links described.

Preferably the suspension system 68 also comprises a trigger deflector 92 to maintain the chain saw in the "on" position during operation. Deflector 92 comprises an elongated trigger cord 94 whose upper end is coupled to a clasp 95 secured to a series of chain links 96 attached atop the handle portion 74. The lower end of trigger cord 94 supports a hook 99 that engages the chain saw trigger.

Figure 9:
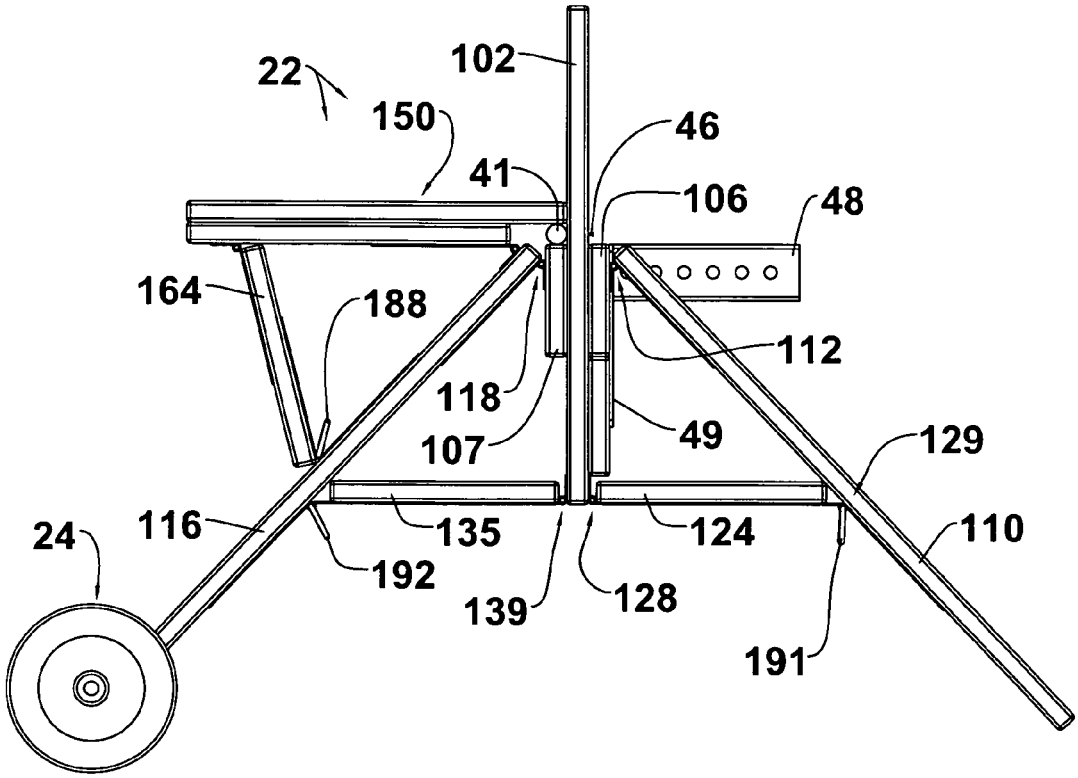
FIGS. 9-12 are fragmentary side elevational views sequentially illustrating the transformation of the carriage from a deployed position to a stowage position.

The multifunctional carriage 22 functions as a worktable to cut workpieces placed upon it. A planar, vertically disposed fence 102 forms the carriage center (i.e., FIGS. 1-3). Central slot 104 (FIG. 6) in fence 102 is penetrated by the saw blade 64 in operation. Items placed on the table described later are cut by the chain saw blade that penetrates slot 104. Dowel rod 41 (i.e., FIGS. 1, 6, 9) can be adjusted in position to measure cuts. Rod 41 is held temporarily in a given position by fastener 46 (FIG. 9, 12).

Figure 4:
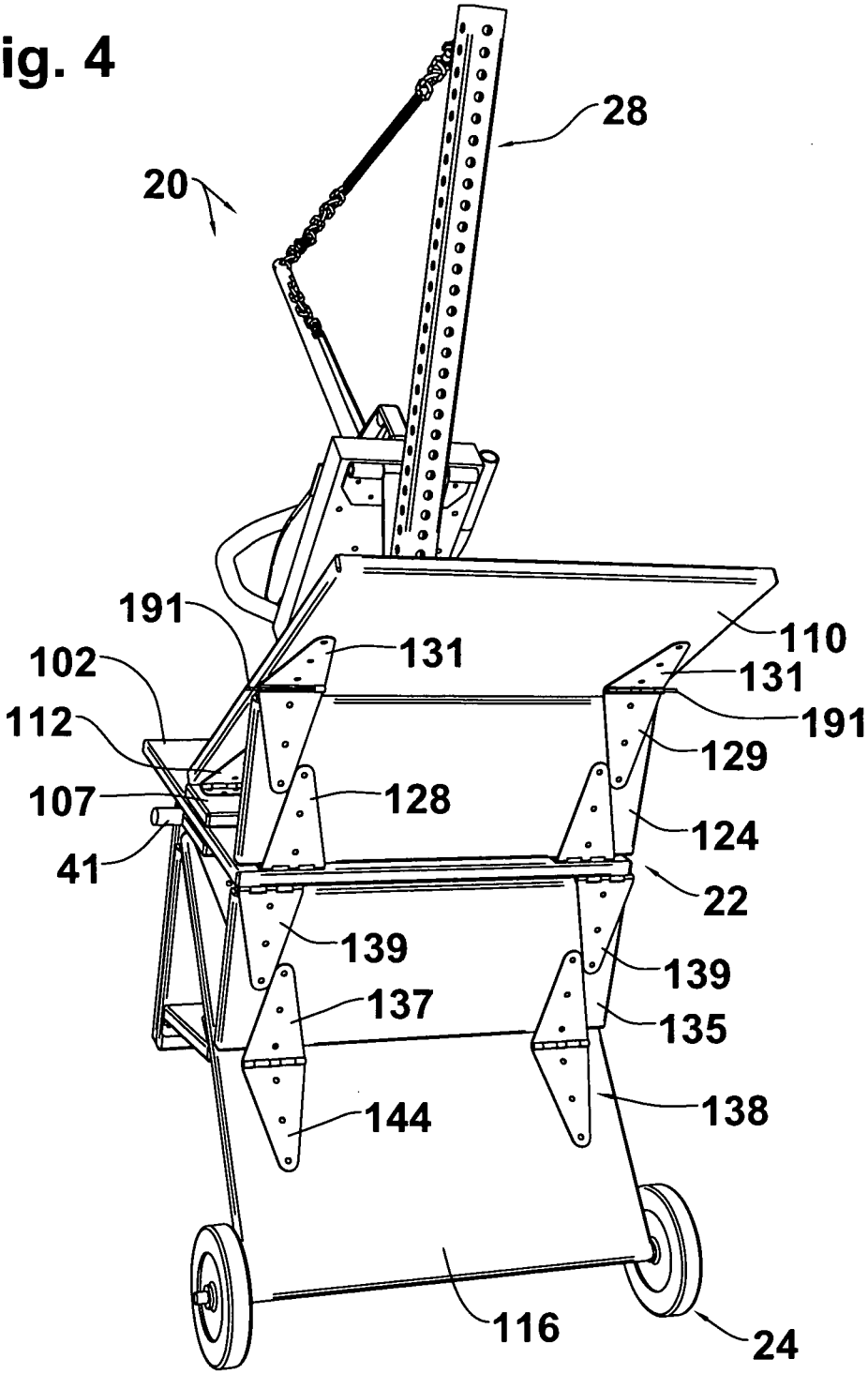
FIG. 4 is a bottom isometric view of the workbench.
Figure 7:
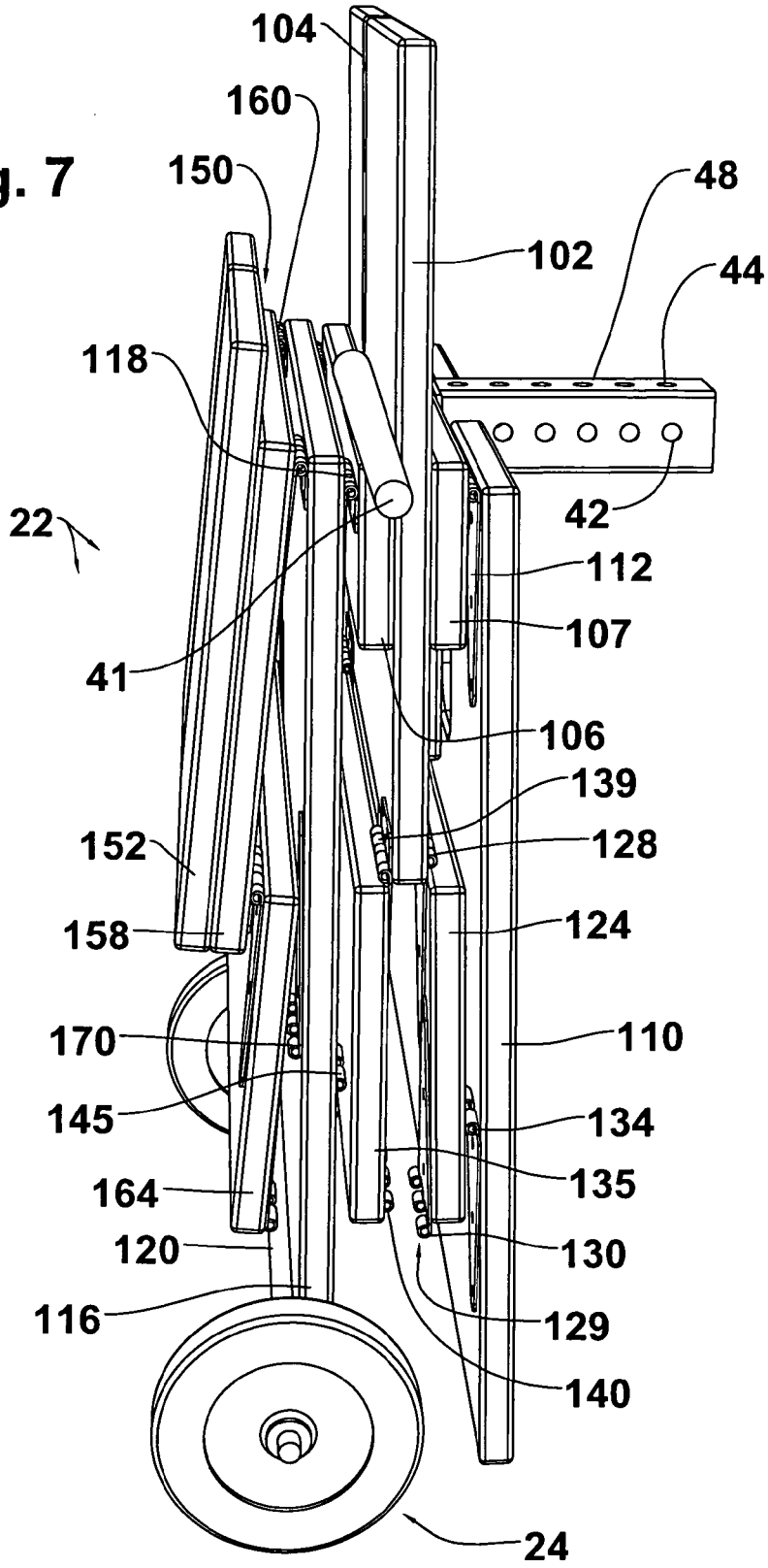
Figure 8:
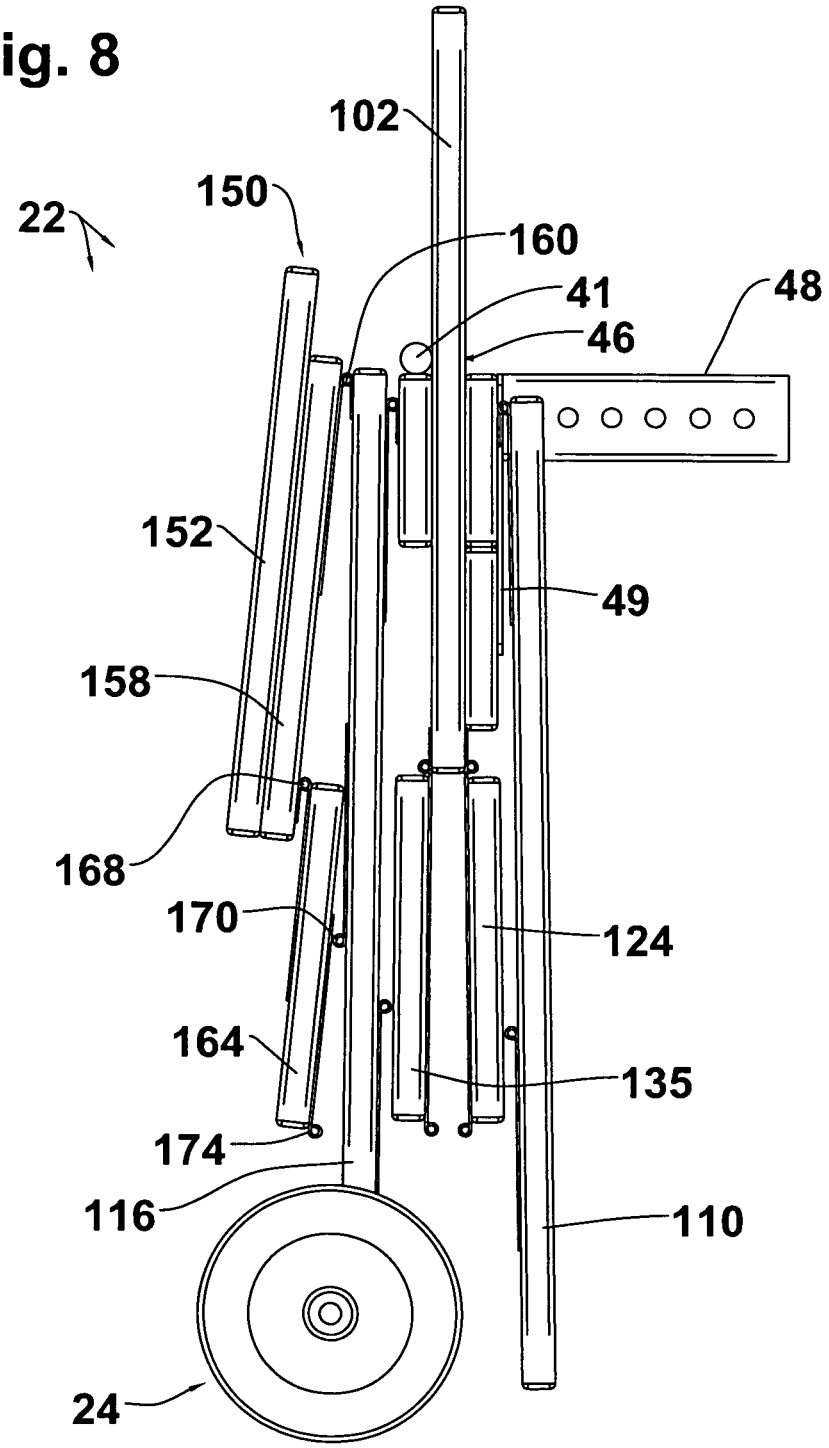
FIG. 8 is an enlarged, side elevational view of the folded carriage.

A pair of flushly mounted, generally rectangular spacers 106, 107 are mounted to fence 102 approximately at the fence center, and extend from side to side. A generally rectangular rear carriage leg 110 is pivotally coupled to spacer 107 with a hinge 112 (FIGS. 4, 7). A generally rectangular front carriage leg 116 is similarly coupled to spacer 106 with a hinge 118. The deployable legs 110, 116 can be unfolded from the stowage position of FIG. 7 to the operational, generally inverted-V shaped position of FIG. 1, where they present a generally triangular cross section. Leg 110 rests directly upon the ground, but leg 116 is equipped with an axle 120 that supports wheels 24 at its opposite ends.

Figure 10:
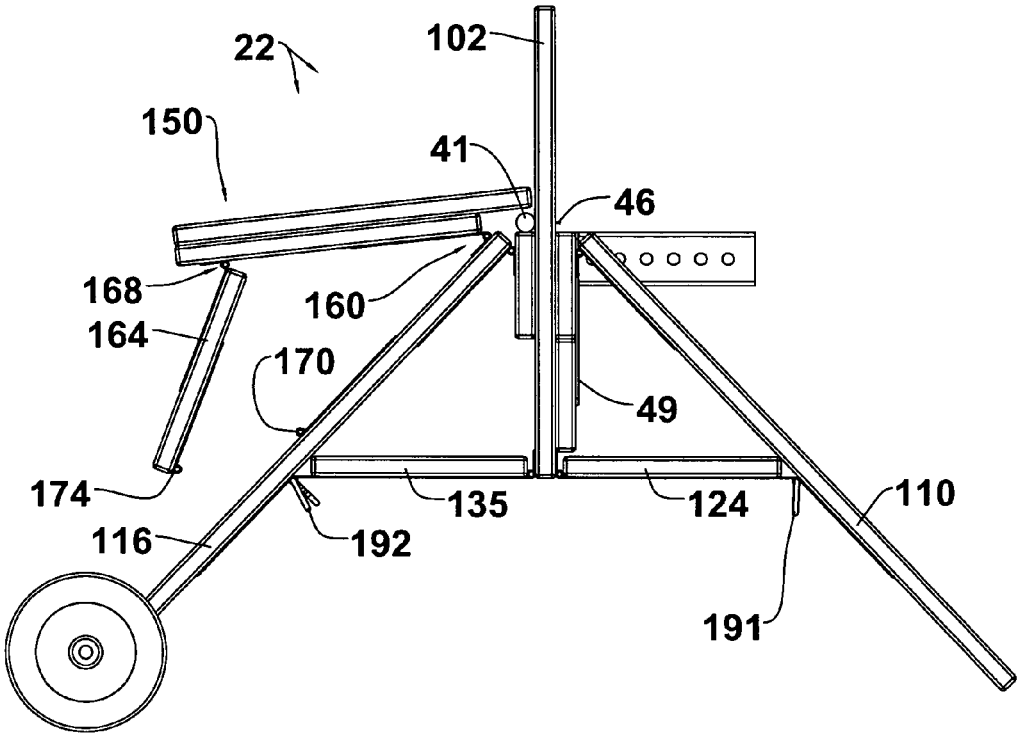
Figure 11:
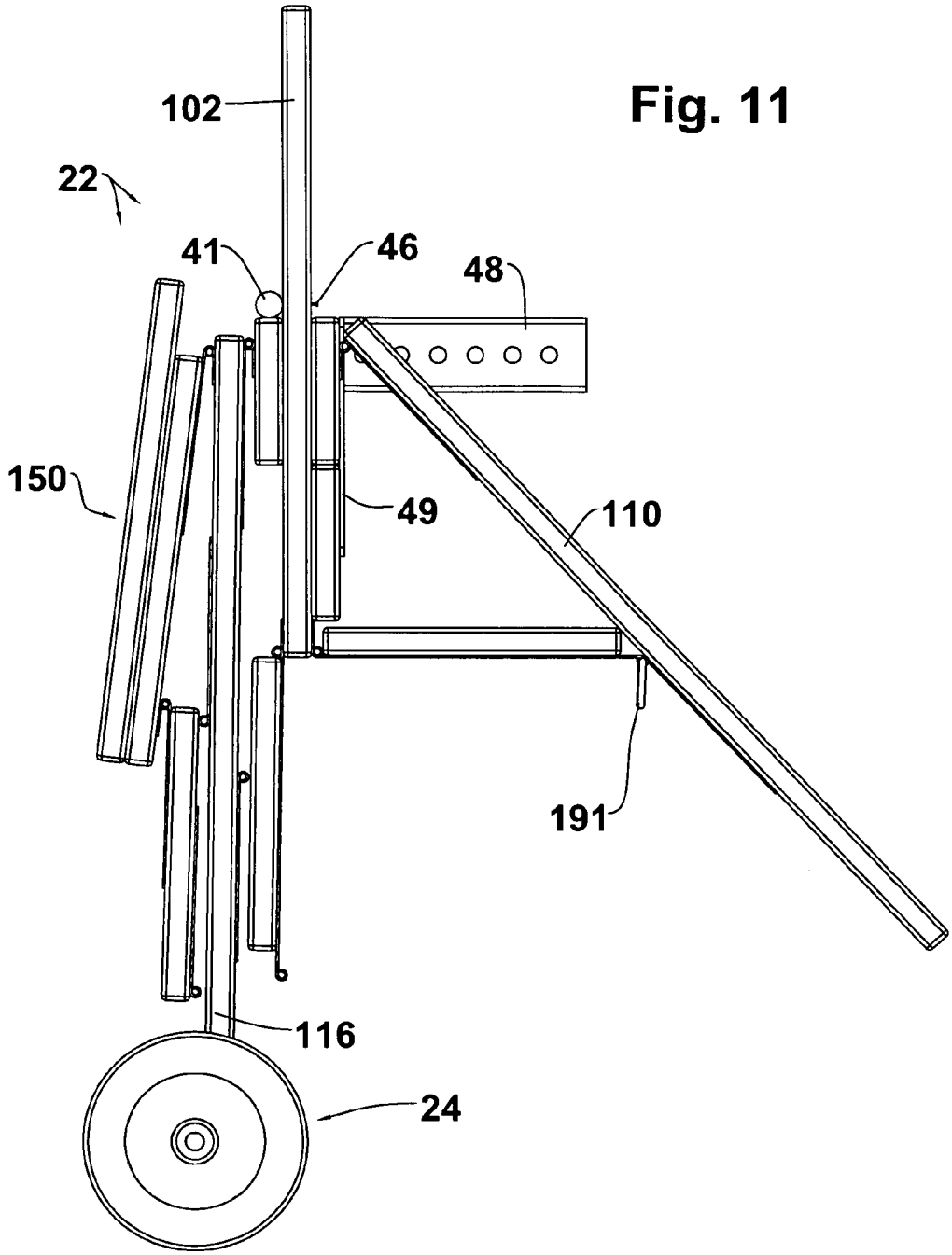
Figure 12:
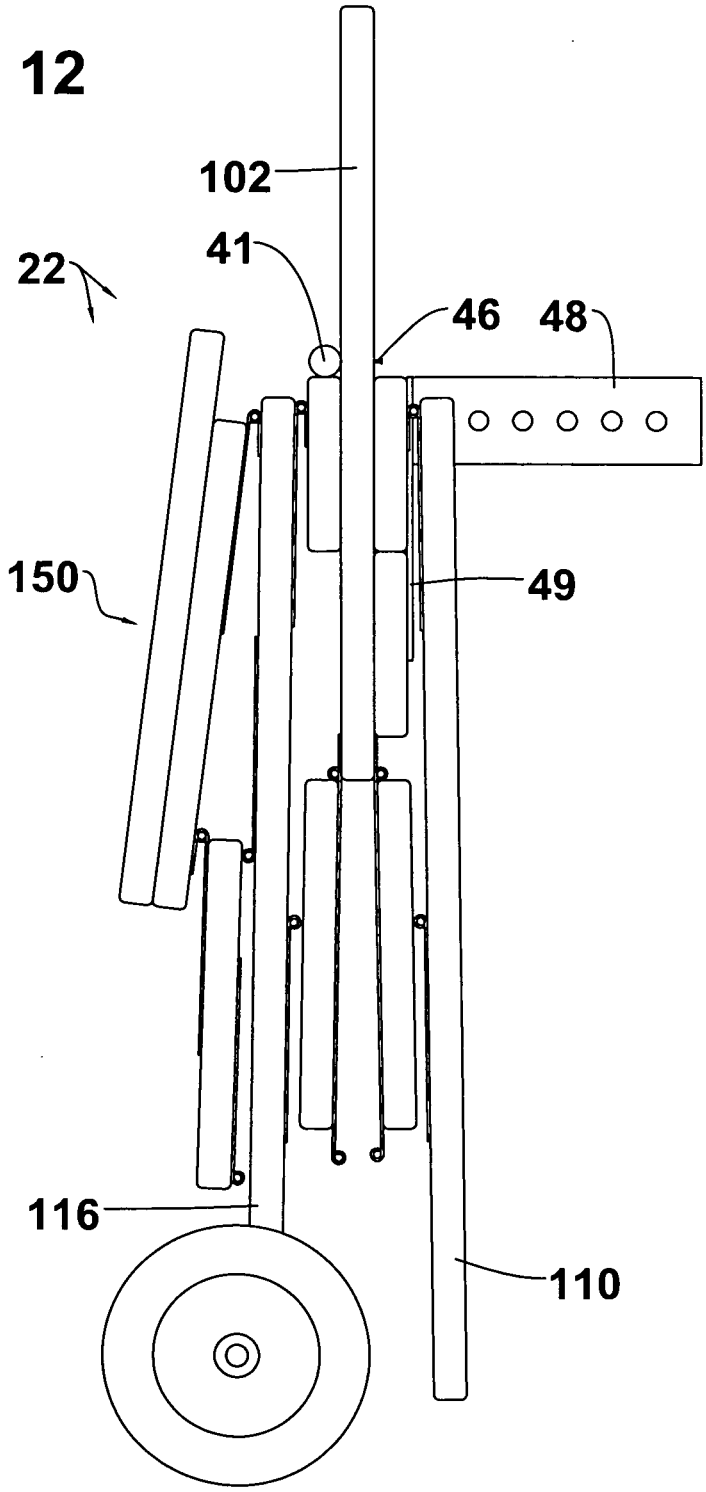

A pair of generally rectangular stabilizers are foldably interconnected with legs 110, 116 to brace the carriage 22 when deployed. A first stabilizer 124 is permanently pivotally coupled to the bottom underside of fence 102 with hinges 128 (FIGS. 4, 7). Spaced-apart hinge leaf halves 129 with ferrules 130 (FIGS. 2, 4) are secured beneath stabilizer 124 to selectively releasably mate by pinning with hinge leaf half 131 on the underside of leg 110. Ferrules 130 (FIG. 7) are selectively pinned to ferrules 134 (FIG. 7) when the carriage 22 is erected with pins 191 (FIG. 10).

Figure 6:
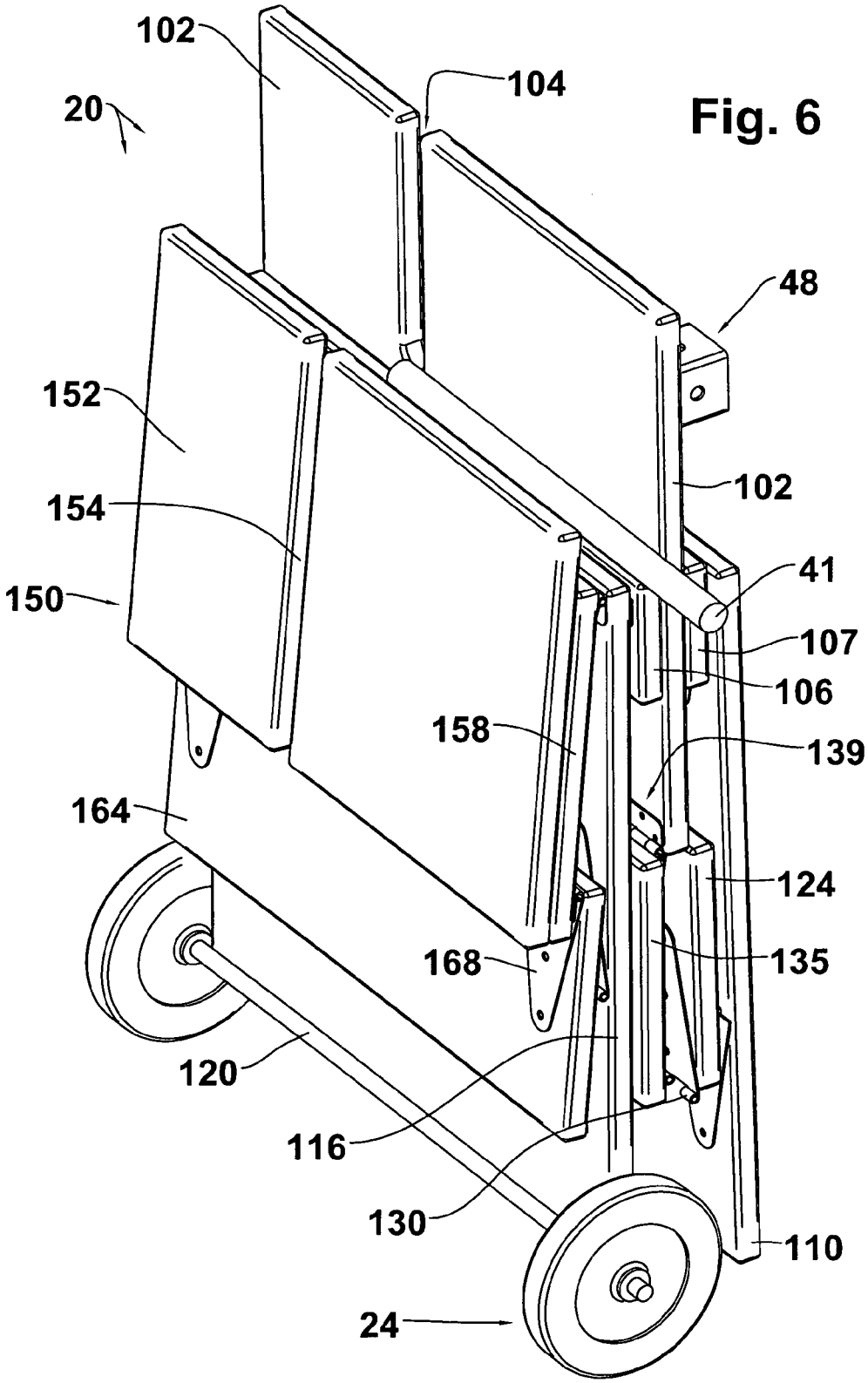
FIGS. 6 and 7 are an enlarged, fragmentary isometric views of the folded carriage.

The opposite stabilizer 135 is permanently pivoted to the underside of fence 102 (FIG. 4, 7) with hinges 139 (FIG. 6, 7). For selective connection stabilizer 135 has similar hinge leaf halves 137 (FIG. 4) with ferrules 140 (FIG. 7). As seen in FIG. 4 there are similar leaf halves 144 (FIG. 4) on the underside of leg 116 that present ferrules 145 (FIG. 7) to mate with ferrules 140 on stabilizer 135 being fastened by pins 192 (FIG. 10).

When the carriage is erected, as in FIG. 1, the stabilizers 124 and 135 abut each other edgewise, and occupy a generally horizontal plane. The use of intermeshing leaf halves facilitate the use of quick-insert pins such as pins 191, 192 (FIG. 10) to join the registering hinge leaf halves to lock the stabilizers 124 and 135 to the deployed legs 110, 116 respectively.

The foldable work table 150 preferably comprises a pair of rigid, generally rectangular boards 152, 158 that are flushly joined together for strength. The upper board 152 (i.e., when deployed) includes a central clearance slot 154 that registers with fence slot 104 previously described for providing saw blade clearance. Table 150 is pivoted to leg 116 by hinges 160 secured beneath the top of board 158 at the underside of board 158. When table 150 is pivoted to the horizontal, operational position of FIG. 1, it is braced by a lower strut 164 that is pivoted to the bottom underside of table 150 (i.e., board 158) by hinges 168. Thus when the table 150 rotates clockwise (i.e., as viewed in FIG. 8) strut 164 can similarly pivot and assume a vertical orientation when table 150 is horizontally disposed during operation. However it will be noted that leg 116 has a pair of hinge leaf halves 170 disposed midway upon its length (i.e., FIG. 4, 10). Similar mating leaf halves 174 are mounted at the bottom underside of strut 164 (FIG. 6). When strut 164 is disposed vertically to support the table 150, the ferrules of leaf halves 170 and 174 register and intermesh, and they can be pinned together with a pin 188 (FIG. 9) to lock strut 164 vertically.

When the erected apparatus is to be disassembled for stowage, the controller 28 can be removed from stub 48 by removing pin 50 (FIG. 5), allowing tube 40 to slidably withdraw. Pin 188 (FIG. 9) can be removed to free the table 150 and strut 164. Then pins 191, 192 are removed to free the stabilizers 124, 135 from the respective legs 110, 116 respectively. The legs are permanently hinged to fence 102, so they may assume the flat, stowage position of FIG. 7).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A portable chain saw workbench comprising:

a foldable carriage adapted to be disposed on a supporting surface, the carriage comprising a deployable table upon which workpieces may be placed for cutting by a chain saw;

a stub proximate the carriage;

a rigid controller for handling a chain saw, the controller comprising:

an elongated, rigid tube removably and telescopingly coupled to the stub, the tube comprising a rear end;

said controller tube and said stub are perforated with spaced apart perforations; said tube coaxially, telescopingly fits to said stub;

a pedestal pivotally secured to the tube, the chain saw being secured to the pedestal;

a handle comprising a lower base portion secured to the pedestal, and an integral upper handle portion extending upwardly and forwardly relative to the chain saw;

a spring suspension for controlling chain saw movements, said spring suspension extending generally diagonally between said handle upper portion and said tube rear end to normally bias the chain saw out of engagement with a workpiece;

pin means for adjustably securing the tube to said stub;

wherein the pin means secures the tube to said stub by selectively penetrating aligned perforations in said tube and said stub when the tube is coupled as desired relative to said stub; and, the carriage comprising a fence deployed between the chain saw and the workpiece, the fence comprising a clearance slot penetrated by the blade of the chain saw.

2. The workbench as defined in claim 1 further comprising a trigger deflector for maintaining the chain saw in the "on" position during operation, the deflector extending between said handle upper handle portion and said chain saw.

3. A portable chain saw workbench comprising:

a foldable carriage adapted to be folded together for stowage or unfolded for use upon a supporting surface, the carriage comprising a deployable table upon which workpieces may be placed for cutting by a chain saw;

a stub supported by the carriage;

a rigid, controller for handling a chain saw, the controller comprising:

an elongated, rigid tube removably and telescopingly coupled to the stub, the tube comprising a rear end;

said tube and said stub are perforated with spaced apart perforations; said tube coaxially, telescopingly fits to said stub; and, wherein the workbench comprises pin means for securing the tube to said stub by selectively penetrating aligned perforations in said tube and said stub when the tube is coupled as desired relative to said stub;

a pedestal pivotally secured to the tube, the chain saw being secured to the pedestal;

a handle comprising a lower base portion secured to the pedestal, and an integral upper handle portion extending upwardly and forwardly relative to the chain saw;

a spring suspension for controlling chain saw movements, said spring suspension extending generally diagonally between said handle upper portion and said tube rear end to normally bias the chain saw out of engagement with a workpiece; and, the carriage further comprising:

a generally planar, vertically disposed fence deployed between the chain saw and the workpiece, the fence comprising a central clearance slot penetrated by the blade of the chain saw;

a pair of generally rectangular legs pivotally coupled to the fence, the legs adapted to be stowed in a position generally parallel with said fence and deployed into a generally inverted-V position where both legs are angled away from said fence; and, deployable stabilizer means for securing said legs when deployed, wherein said stabilizer means comprises panels permanently coupled through hinge means to one of said fence or said legs, and removably hinged through half leaves of hinges to the other of fence or said legs.

4. The workbench as defined in claim 3 further comprising a trigger deflector for maintaining the chain saw in the "on" position during operation, the deflector extending between said handle upper handle portion and said chain saw.

* * * * *